United States Patent [19]

Zaslow

[11] 3,953,940

[45] May 4, 1976

[54] COUNTERFORCE ASSEMBLY FOR DOORS

[76] Inventor: Joseph Zaslow, 2607 Ave. X, Brooklyn, N.Y. 11235

[22] Filed: Oct. 17, 1974

[21] Appl. No.: 515,495

[52] U.S. Cl. ..... 49/135; 49/114; 52/2

[51] Int. Cl.[2] ..... E06B 11/04

[58] Field of Search ..... 49/135, 386, 171, 276, 49/114, 115; 52/2; 98/87

[56] References Cited

UNITED STATES PATENTS

| | | | |
|---|---|---|---|
| 2,218,505 | 10/1940 | Chambers | 49/114 X |
| 2,332,753 | 10/1943 | Rawlings | 49/114 X |
| 2,823,429 | 2/1958 | Grant | 98/87 X |
| 3,314,198 | 4/1967 | Frisk | 49/386 X |
| 3,407,534 | 10/1968 | Bird | 52/2 X |

*Primary Examiner*—Kenneth Downey
*Attorney, Agent, or Firm*—Friedman & Goodman

[57] ABSTRACT

A counterforce assembly is described for use with doors that are exposed to high pressure differentials on the two sides thereof which result in large forces acting on the doors which tend to maintain the same closed against a door jamb and make the same difficult to open. The assembly includes a counterforce panel. The panel is typically hingedly mounted and has one major side thereof covered by a pressure shield. The covered side is vented to the low pressure side of the door and maintained at the low pressure while the other major side of the panel is exposed to the high pressure side, so that the panel is exposed to the same pressure differential as is the door and a resulting net force acts on the panel. Coupling means, which may be in the form of a pressure plate, a fulcrum arm, a linkage or a pulley arrangement, is connected to the panel and releasably connected to the door for applying the force acting on the panel to the door and counteracting the force acting on the door until the latter is opened and the pressures on the two sides of the door are equalized. The panel thereby counteracts the forces acting on the door and facilitates opening of the latter irrespective of the magnitudes of the pressure differentials to which the door and panel are exposed.

13 Claims, 14 Drawing Figures

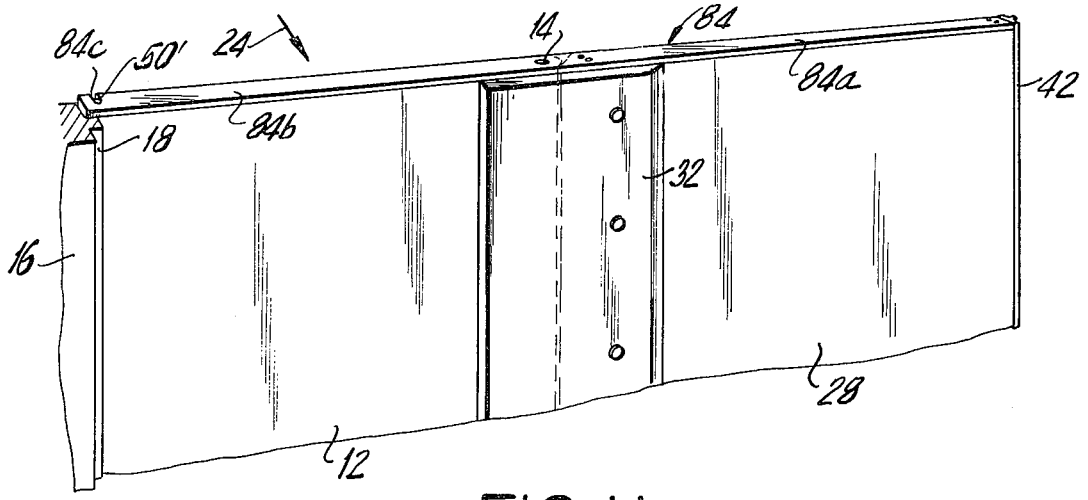
FIG. 11
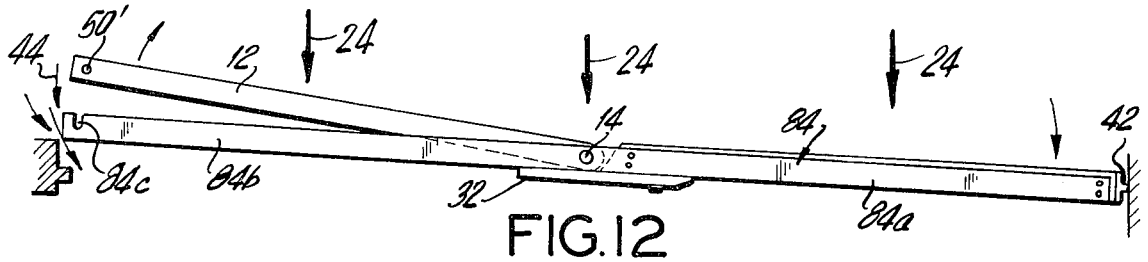
FIG. 12
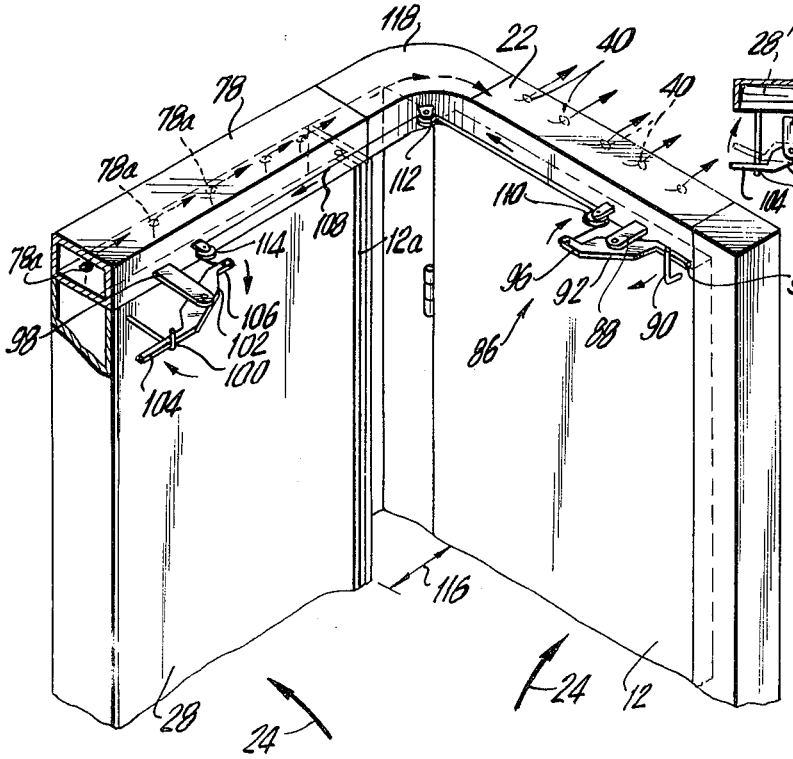
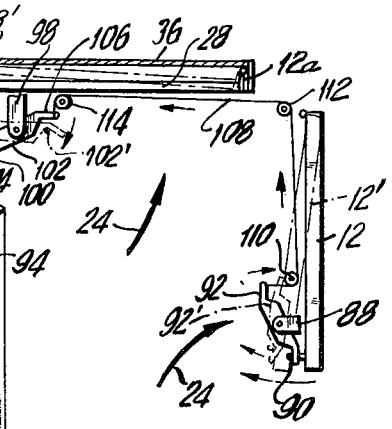
FIG. 14
FIG. 13

COUNTERFORCE ASSEMBLY FOR DOORS

BACKGROUND OF THE INVENTION

The present invention generally relates to door constructions, and more specifically to a counterforce assembly for doors which counterbalances or compensates for high pressures on one side of a door to thereby facilitate opening of the door irrespective of the absolute pressures which act on the same.

The pressures on the two sides of a door may vary substantially in certain instances. For example, a door exposed to the exterior of a structure may be exposed to high winds and other atmospheric conditions which create a pressure acting on the exterior of the door which is substantially higher than the low pressures of the interior of the structure. In such instances, it becomes difficult, if not impossible, for one or even two or more individuals to open the door against the high resulting forces. To open a door under these conditions it is necessary for the person opening the door to apply a force which is equal to the pressure differential on the two sides of the door acting over the surface area of the door.

According to a recent development, the fire codes of some large cities require that pressurization systems be provided along the stairwells of high rise buildings with the aim of preventing the spread of smoke and fire into stairwell areas. With such a system, a large blower is provided which causes a forced air flow through the stairwells. The resultant pressure, applied over area of the door, can create a force of up to one thousand pounds which must be overcome. Clearly, such high pressure applied to a fire door will prevent the opening of the same by one, or even two or more individuals. There is not known in the prior art a practical and inexpensive means for assisting the opening of doors which are subjected to high pressure differentials of the type above suggested.

The present invention is for a counterforce assembly which cooperates with a door which may be subjected to high pressure differentials. The counterforce assembly cooperates with the door, either by means of a pressure plate, a fulcrum arm, a series of linkages, a pulley arrangement, or other coupling means to apply a counterforce to the door which tends to open the latter. The counterforce which is applied to the door may be of a magnitude which is substantially equal to the magnitude of the force exerted upon the door itself. In this manner, the counterforce assembly only compensates or negates the effect of the high forces exerted by the high pressures, and permits the door to be opened by the application of a relatively small force. The small force now required need only be large enough to overcome friction at the hinges, springs or door return mechanisms. According to the broad principle of the present invention, the counterforce assembly may be dimensioned to undercompensate, fully compensate or overcompensate the forces applied to the door. Accordingly, the counterforce assembly provides substantial flexibility in the manner in which the door can be controlled. Counterforce assemblies of the type contemplated may be utilized in conjunction with fire doors where blowers are utilized or with doors which are exposed to high atmospheric pressures, such as in cyclone regions and in many other instances where high pressure differentials acting upon a door are anticipated.

SUMMARY OF THE INVENTION

It is an object of the present invention to provide a counterforce assembly for doors which overcomes the disadvantages in the use of conventional doors in areas where the same are exposed to high differentials.

It is another object of the present invention to provide a counterforce assembly of the type under discussion which is simple in construction and economical to manufacture.

It is still another object of the present invention to provide a counterforce assembly of the type above suggested which includes a counterforce panel whose dimensions may be selected to undercompensate, fully compensate or overcompensate the forces which are applied to the door and which tend to maintain the same in a closed position against a door jamb.

It is yet another object of the present invention to provide a counterforce assembly for doors which may be incorporated into new structures which house the associated door or which may be added as a retrofit installation to existing structures.

It is a further object of the present invention to provide a counterforce assembly for doors which may be disposed adjacent to the associated doors or, when required, may be disposed remote from the associated doors and which, in both cases, are coupled to the associated doors with suitable coupling means for transmitting forces acting upon the counterforce assembly to the door to facilitate opening of the latter.

It is still a further object of the present invention to provide a counterforce assembly for doors which includes a counterforce panel, and wherein venting means are provided for venting one side of the pressure panel to a low pressure side of the door and the other side of the panel to the high pressure side of the door, whereby the pressure differential across the panel is the same as those across the door and net resulting forces acting upon the panel may, by means of suitable coupling devices, be applied to the door to counteract the forces acting on the latter.

To achieve the above objects, as well as others which will become apparent hereafter, the counterforce assembly in accordance with the present invention comprises a planar counterforce panel mounted for movement and exposed to substantially the same high pressure differentials to which an associated door is exposed to result in net forces acting on said panel. Coupling means are provided connected to the door and to said panel for applying the force acting on the latter to the door and counteracting the force acting on the door. In this manner, movement of said panel, when coupled to the door, counteracts forces acting on the latter and facilitates opening of the door irrespective of the magnitudes of the pressure differentials to which the door and said panel are exposed.

According to a presently preferred embodiment, a pressure shield is provided having a major opening having diemensions comparable to those of said panel. Said panel is mounted for substantially transverse movements within the pressure shield to sealingly close said major opening at all positions of said panel and to form together with said pressure shield a sealed compartment. One surface of said panel is exposed to the exterior of said compartment into the high pressure side to which one side of the door is exposed. The other surface of said panel faces the interior of said compartment. Venting means is provided for venting the interior of said compartment to the low pressure side to which the other side of the door is exposed so that the pressure differential is maintained the same on the door and on said panel in all positions of the latter within said pressure shield.

When the door and said panel are contiguously positioned, said coupling means may be in the form of a fulcrum arm extending across the top edges of the door and said panel or a pressure plate which is fixed to said panel and which may abut against the door. When the door and said panel are remote from one another or contiguously to one another, said coupling means may be in the form of a linkage arrangement or a pulley and lever arm arrangement or a combination of the same. In each case, movements of said panel, under the action of the pressure differential and resulting forces caused thereby, within said pressure shield are transmitted by means of the respective coupling means to a portion of the door in a manner to counteract or oppose the forces which the pressure differential applies to the door to tend to maintain the same in a closed position against the door jamb.

A further important feature of the present invention is that said coupling means includes a release mechanism whereby the coupling means is coupled or engaged with the door only until the latter is opened and the pressures on the two sides of the door are equalized. Subsequent to movement of the door to such a position, the door is released or disengaged from the coupling means and may move independently of further movements of said coupling means and said panel. In this manner, the movements of said panel are limited within said pressure shield to achieve the desired opening of the door without excessive movements of said panel and, therefore, excessive dimensions of said pressure shield.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 11 is a perspective view similar to FIG. 1, showing the use of a fulcrum arm as a coupling means between the door and the panel in place of the pressure plate;

FIG. 12 is a top plan view of the arrangement shown in FIG. 11, and similar to FIG. 3, showing the manner in which the door is released from the fulcrum arm once the panel has moved to a position corresponding to an open door condition wherein the pressure seal at the door is broken and the pressure is equalized on both sides of the door;

FIG. 13 is similar to FIG. 9, but showing a pulley arrangement in place of linkages to couple the panel to the door, and also showing a venting duct for venting one side of the panel to the low pressure side of the door when the door and panel are not contiguous to each other; and FIG. 14 is a schematic representation of the arrangement shown in FIG. 13, showing the manner in which the pulley arrangement and associated level arms transmit the forces acting on the panel to the door.

DESCRIPTION OF THE PREFERRED EMBODIMENTS

Figure 1:
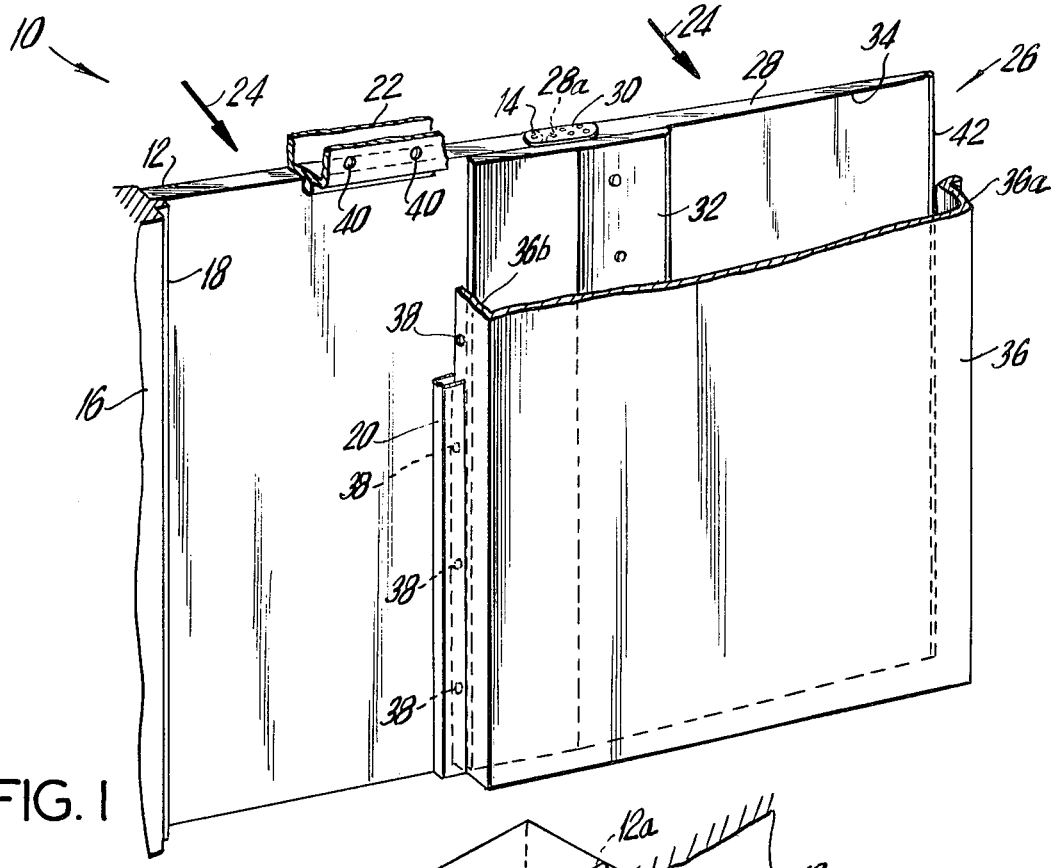
FIG. 1 is a perspective view, partly broken away and in cross section of a counterforce assembly acting or cooperating with a door which is subject to high pressure differentials, and further showing air venting means which permits free movement of a counterforce panel into a pressure shield.
Figure 2:
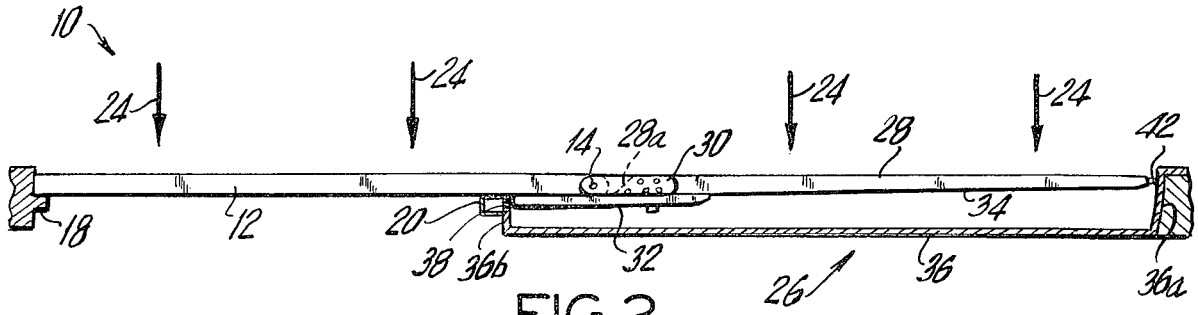
FIGS. 2–4 are top plan views of the door and counterforce assembly shown in FIG. 1, respectively showing the closed, partially open and fully open conditions of the door.
Figure 3:
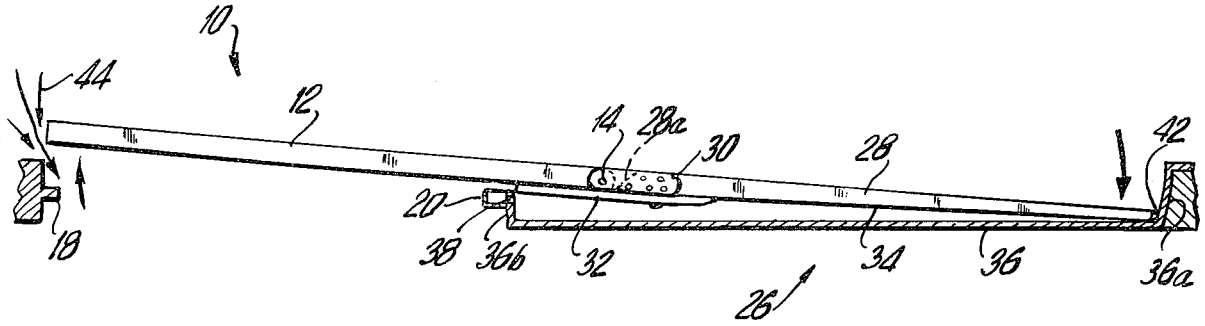
Figure 4:
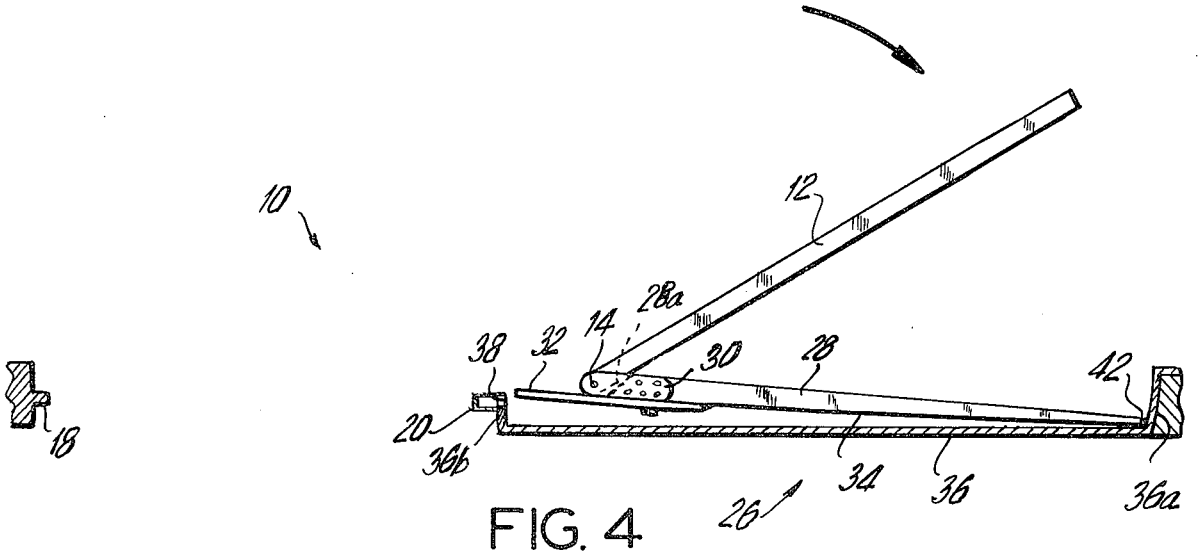

Referring now to the drawings in which the identical or similar parts are designated by the same reference numerals throughout, and first referring to FIGS. 1–4, a door system 10 incorporating the novel invention is shown wherein a primary or main door 12 is hingedly mounted about a vertical hinge pin 14 and is movable between a closed position shown in FIGS. 1 and 2 and open positions shown in FIGS. 3 and 4.

While the present invention will be described with specific reference to fire doors which are exposed to high pressure differentials on the two sides thereof, as described in the BACKGROUND OF THE INVENTION, it will be clear from the description that follows that identical or similar structures may be utilized with any doors which may be difficult to open due to the above described pressure conditions.

The door, in its closed position, is generally received within a frame 16 in abutting relationship against jambs 18 and 20 in a conventional manner. The frame 16 is advantageously hollow, for reasons to be described hereafter, and includes an upper transverse frame member 22, a portion of which is exposed to the low pressure side of the door 12.

As suggested above, a door such as door 12 may be exposed to high pressure differentials wherein a high pressure, generally indicated by the arrows 24 in the FIGURES, is applied to one side of the door 12 with the other side of the door being maintained at a low pressure. With conventional doors, opening of the door 12 against the action of the pressure 24 may be difficult or in some instances impossible by one, two or several individuals.

An important feature of the present invention is the provision of a counterforce assembly, generally designated by the reference numeral 26, which cooperates with the door to counteract or compensate for the high pressures which act upon the door.

In FIGS. 1–4, the counterforce assembly 26 includes a counterforce panel 28 which has one side thereof exposed to the high pressure or exterior side of the structure. The counterforce panel 28 is hingedly mounted about a hinge pin 14 by means of a hinge plate 30 so that both the door 12 and the counterforce panel 28 are hingedly mounted about the same pin. However, this is not a critical feature of the invention, as will become clear from the description that follows.

A pressure plate 32, suitably connected to the counterforce panel 28, extends from the counterforce panel beyond the hinge pin 14 so that at least a portion thereof is coextensive with the door 12. When the door 12 is in the closed condition, the projecting portion of the pressure plate 32 is in abutment against the door 12.

A pressure shield or chamber 36 sealingly covers one side of the counterforce panel 28 and the pressure plate in all anticipated positions of the counterforce panel. The pressure shield 36 and the panel 28 together define a low pressure compartment sealed from the high pressure side. One end wall 36*a* of the pressure shield 36 may be slightly curved so that the edge of the counterforce panel maintains a seal between the high pressure on the exterior of the counterforce panel and the interior of the pressure shield.

As made evident in FIGS. 2–3, movement of the counterforce panel 28 into the pressure shield 36 tends to compress the air within the pressure shield or tends to compress the air trapped therein. To facilitate movement of the counterforce panel 28 into the pressure shield 36, there is provided venting means which may be in the form of a series of vent holes 38 within the end wall 36*b* of the pressure shield 36 which permits the air trapped within the pressure shield to escape into the hollow jam 20 and thereafter be forced upwardly into the upper transverse frame member 22 and out of vent holes 40. In this manner, the high pressures are maintained exteriorly of the door 12 and the counterforce panel 28 with the air within the pressure shield being vented to the low pressure region and thereby maintained at a low pressure. To increase the seal between the high and low pressure zones, a suitable seal 42 may be provided between the edge of the counterforce panel and the curved wall 36*a*.

Referring to FIGS. 1–4, the operation of the door system 10 will now be described. With the door 12 closed as shown in FIGS. 1 and 2, a pressure differential acting over the surface area of the door 12 exerts a force upon the door which tends to close the same against the jambs 18 and 20. Simultaneously, because the counterforce panel is exposed to the same high pressure differentials, a pressure over the area of the panel similarly results in a force acting upon the same. While the pressures acting upon the door tend to be in counter-clockwise direction about the hinge pin 14, as viewed in FIGS. 2–4, the net force acting upon the counterforce panel 28 tends to be in a clockwise direction about the hinge pin 14. Clearly, when the surface areas of the door 12 and of the counterforce panel 28 are made equal, the net forces resulting on each of these members is equal, but in opposite directions upon the hinge pin 14.

The counterforce panel acting on the pressure plate 32 causes a clockwise moment or torque to be applied upon the door 12. The action of the pressure plate 32 is such as to cause the door 12 to rotate in a clockwise direction about the hinge pin 14. Thus, the action of the counterforce panel, with the pressure plate 32, is to counteract the force which is exerted on the door 12 in the counter-clockwise direction. By suitable selection of the ratio of the surface areas of the door 12 and the panel 28, the net force resulting upon the door 12 due to the high pressure 24 may be totally compensated for or, if desired, overcompensated, in which case the door opens against the action of the high pressure. In accordance with a presently preferred embodiment, the dimensions of the panel 28 relative to the door 12 are selected to result in a net counter-clockwise force on the door which is, however, relatively small to permit the opening of the door 12 with facility by a single individual. In this condition, the panel 28 almost, but not completely, compensates for the force acting on the door due to the high pressure. Thus, the door remains closed but may be opened without any undue difficulty as is the case with prior art arrangements.

The counterforce panel need only be utilized until the seal between the high and low pressure sides is broken at the door 12. As soon as the door is sufficiently opened, the pressure seal existing at the door is broken and the pressure acting on the two sides of the door are equalized and the door may be moved to any open position without further assistance of the counterforce panel 28.

In FIG. 2, the door 12 is in the closed position and the panel 28 is in its fully extended position. When the door 12 is moved to the position shown in FIG. 3, the seal is broken due to the inrush of air 44. It is for movements of the door 12 from the position shown in FIG. 2 to the position shown in FIG. 3 that the assistance of the counterforce panel 28 is necessary. Once the pressure has been equalized on both sides of the door 12, the door may be opened to any other position, for example as shown in FIG. 4, while the counterforce panel 28 and the pressure plate 32 remain in their positions shown in FIG. 3.

To facilitate full opening of the door as shown in FIG. 4, the panel 28 is advantageously provided with a chamfer or inclined surface 28*a* which prevents interference between the door and the panel at wide angular open positions of the door.

As suggested above, the counterforce panel 28 moves from its fully extended position as shown in FIG. 2 to positions interiorly of the pressure shield 36 to cause the pressure plate 32 to exert a counterbalancing or compensating force upon the door 12. Since the pressure shield 36 may desirably be mounted within a wall, the pressure shield 36 advantageously has little depth to permit the same to be contained within the wall. To increase the extent of pivoting or angular movements of the panel 28 within the shallow pressure shield 36, the panel 28 is advantageously provided either with a taper or chamber 34 in the region of the seal 42 which increases the extent of permissible travel of the panel within the pressure shield before engaging with the latter. Any additional distance requirements of movement of the panel may be achieved by suitably extending the pressure shield forward of the wall on the high pressure side.

Figure 5:
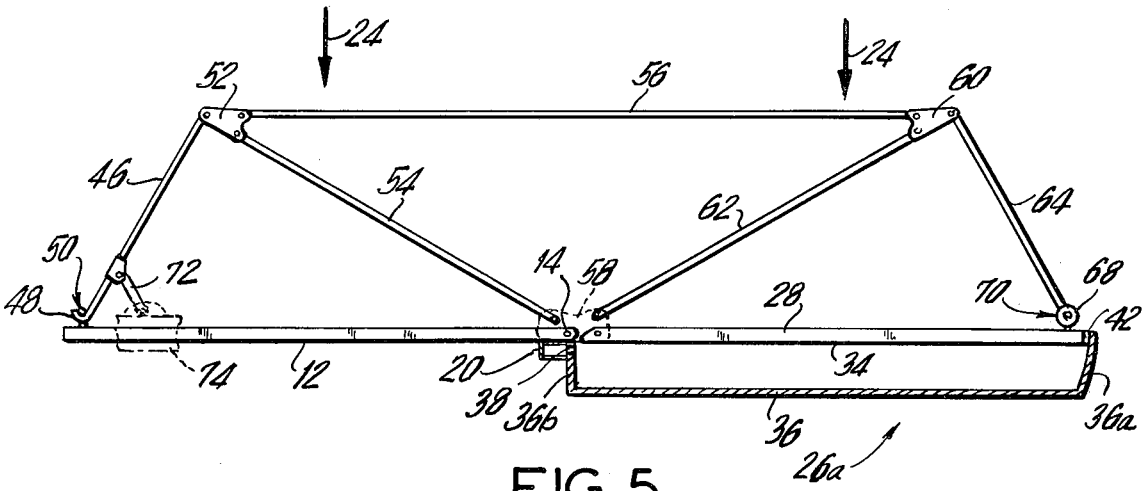
FIG. 5 is a top plan view similar to FIG. 2 but showing the use of a linkage arrangement in place of a pressure plate attached to the counterforce panel.

In FIG. 5, a door 12 is shown to cooperate with a modified counterforce assembly 26*a* which utilizes a linkage system in place of the pressure plate 32. In this arrangement, a link 46 is provided with a hook 48 at one end thereof which is engageable with an offset pin 50 connected to the door 12.

The link 46 is hingedly connected by means of a linkage plate 52 to a link 54 and a tie rod 56. The linkage 54 is hingedly connected to a linkage plate 58 positioned above the hinge pin on which the door and the counterforce panel may be mounted. The tie rod 56 is in turn hingedly connected by means of a linkage plate 60 to a link 62 and a link 64. Link 62 is similarly hingedly connected to the linkage plate 58 while the link 64 is hingedly connected to an offset pin 70 by means of an eye hook 68. For reasons which will become clear hereafter, the linkage 46 is supported by a link support 72 which itself is pivotally mounted on a pivot mount 74, with the latter being mounted on the door frame.

The door system shown in FIG. 5 is a schematic representation which illustrates the principle of the present invention. With high pressures acting upon the door 12 and the panel 28, on the side indicated by the arrows 24, the door 12 tends to pivot in a counterclockwise direction and the panel 28 in a clockwise direction within the pressure shield 36 as suggested above. In this instance, clockwise rotation of the panel 28 exerts a clockwise moment on the door 12 by means of the linkage system as long as the hook 48 is engaged with the pin 50. As with the pressure plate arrangement, once the seal at the door is broken, and the pressures are equalized on both sides of the door, the function of the counterforce assembly is no longer required and the pin 50 may separate from the hook 48 to thereby release the door 12 and permit the same to open to any desired position without corresponding accompanying movement of the linkage assembly. Thus, the linkage assembly has limited movement which corresponds to limited movement of the counterforce panel 28 within the pressure shield 36.

Figure 6:
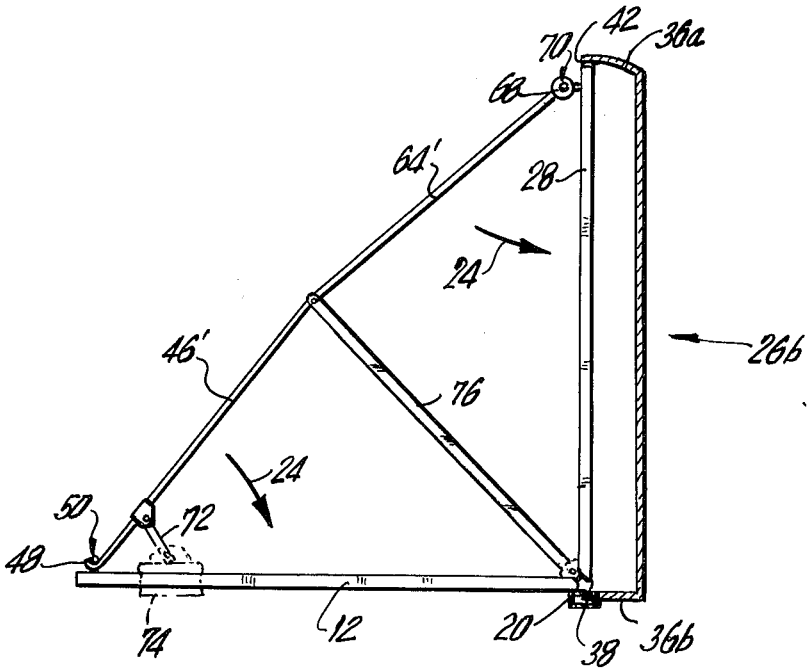
FIG. 6 is similar to FIG. 5, wherein a linkage system is utilized with a door and a counterforce assembly which are oriented at 90° to each other.

A linkage arrangement similar to that shown in FIG. 5 is shown in FIG. 6 wherein the door 12 and the counterforce panel 28 are at a 90° angle to one another. Again, the high pressures are exerted on the exterior surfaces of the door and panel as indicated by the arrows 24. The same parts are designated by the same reference numerals while corresponding parts are primed in FIG. 6. The counterforce assembly in FIG. 6 is designated by the reference numeral **26*b* and in all important functional respects performs similarly to the counterforce assemblies 26 and 26*a* in FIGS. 1–4 and 5 respectively. In the arrangement of FIG. 6, the links 54 and 62 and the tie rod 56 are replaced by a link 76.** In all other respects, the principle of operation is the same.

Figure 7:
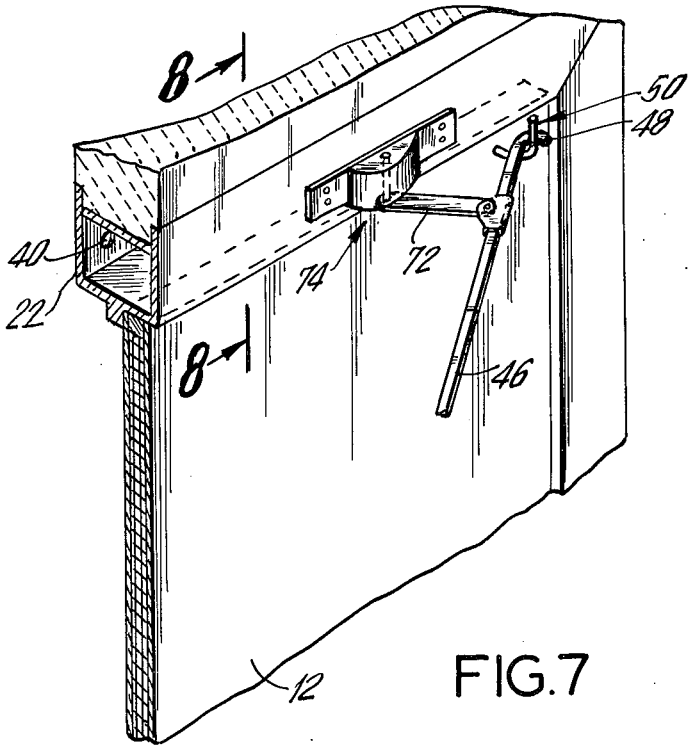
FIG. 7 is a perspective view, partially broken and in cross section, of the door shown in FIG. 5, showing the details of the manner in which the linkage cooperate with the door.

The details of the linkage support arrangement and hook arrangement of FIGS. 5 and 6 is shown in FIG. 7. As shown, the hook 48 is disposed behind the pin 50 and is configurated to disengage from or release the pin and the door 12 once the latter opens sufficiently to result in equalization of pressures on the two sides thereof. The support link 72 is provided to support the linkage assemblies shown in FIGS. 5 and 6 and prevent the same from sagging under their own weight. In this manner, the engagement of the hook 48 with the pin 50 is assured upon the return of the door to the closed position.

Figure 8:
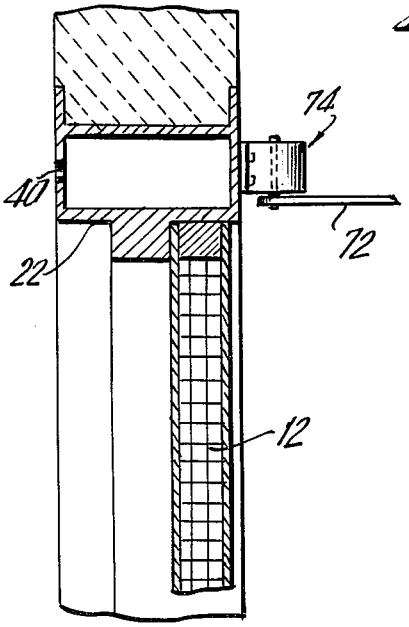
FIG. 8 is a cross section of FIG. 7, taken at line 8—8.

The air vent holes 40 are shown in FIGS. 7 and 8 to illustrate the manner in which the air captured within the pressure shield 36 is vented to the low pressure side at a level above the door through the holes or apertures 40. Referring to FIG. 1, the air is forced out through the holes 38 in the pressure shield, forced up through the jamb 20 in to the upper transverse frame member 22. This arrangement assures that the air, and possible dust and soot which may be present in the pressure shield, is not expelled at the individual opening the door but above the individual.

Figure 9:
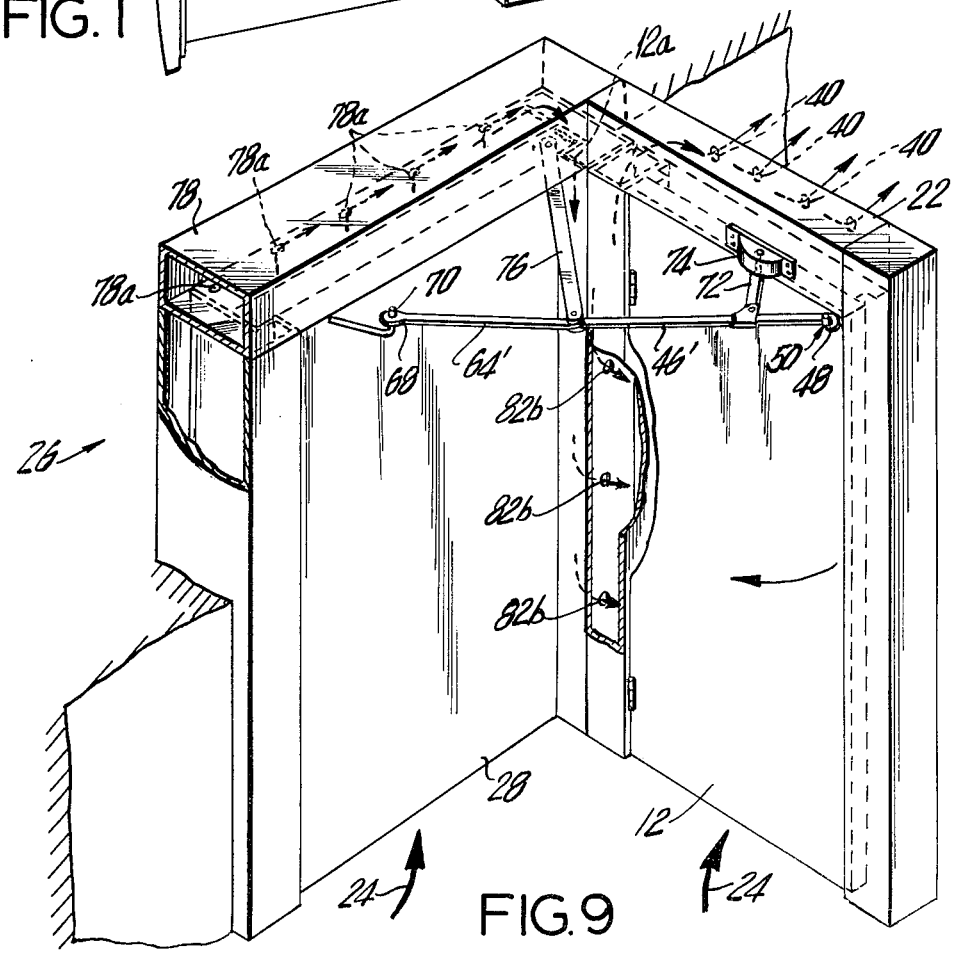
FIG. 9 is a perspective view, shown partly broken away and in cross section of an arrangement similar to that shown in FIG. 6, but showing a slightly modified air venting arrangement.
Figure 10:
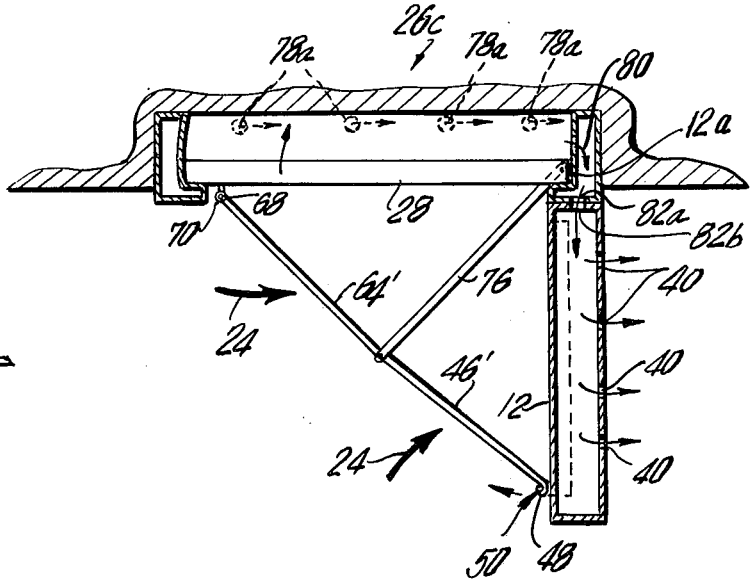
FIG. 10 is a top plan view, partly in cross section, of the door assembly shown in FIG. 9.

An alternate arrangement for venting the air present in the pressure shield 36 is shown in FIGS. 9 and 10 when the panel 28 and the door are at 90° angles to each other. With this modified venting arrangement, vent holes **78*a* are formed in the upper or transverse frame member 78 which closes or covers the upper portion of the pressure shield 36. The holes 78*a* are disposed sufficiently towards the rear of the pressure shield so that the same are not blocked by the advancing counterforce panel 28 in the fully advanced position within the pressure shield. The hollow frame which receives the door 12 and includes the upper transverse member 22 is disposed in abutting relation to the frame which receives the panel 28. Holes 82*a* and holes 82*b* provided within the respective frames of the panel and door are aligned with each other to permit air movement from the one frame to the other. As before, vent holes 40 are provided in the upper frame member 22** to permit the air to be expelled at the top of the door into a low pressure region without being directed at the individual.

The construction shown in FIGS. 9 and 10 is particularly suitable where the door and panels are normal to each other and the panel is disposed in a solid wall which is deeper than the depth of the pressure shield 36. This permits venting of air from the pressure shield to the low pressure side of the door. In both of these FIGURES, the panel 12 is mounted on the frame 78 by means of a piano hinge **12*a* which serves both to hingedly mount the panel as well as act as a seal which prevents free flow of air from the high to the low pressure sides and which prevents pressure equalization inside and outside of the pressure shield. Where, for example, the door 12 and the panel 28 are mounted about a common hinge pin, a piano hinge need not be used since an effective seal is maintained therebetween during initial movements, as suggested in FIGS. 2 and 3.**

Referring to FIGS. 11 and 12, it should be clear that the use of a pressure plate 32 to open the door results in very large stresses on both the door 12 and the panel 28 in the region of the pin 14. It is in this region that the torques are transmitted from the panel 28 to the door 12 by way of the pressure plate 32. Since the high force is applied over the entire surface area of the door 12, the portions of the door which are not in contact with the pressure plate 32 tend to resist movement. This effect manifests itself in a buckling or deformation of the door which causes the door 12 to arch outwardly to an extent which is a function of the absolute forces acting upon the door, the rigidity of the material from which the door is made, as well as the stresses which the door, panel and mounting devices can sustain.

To minimize the above described deformations of the door and panel when a pressure plate 32 is utilized, a fulcrum arm 84 is shown in FIGS. 11 and 12 having one portion thereof **84*a* connected to the top edge of the panel 28 and the other portion thereof 84*b* extending along the upper edge of the door 12 and being provided with a frontally opened slot or aperture 84*c*. A pin 50′ upwardly projecting from the edge of the door is receivable within the slot 84*c* when the door 12 is closed. As with the above described embodiments, the slot 84*c* represents a release mechanism which permits engagement with the pin 50′ during initial opening of the door while permitting disengagement and separation of the pin 50' from the slot 84***c* once the pressure seal at the door has been broken and the door continues to open independently of the further movements of the panel 28. It should be clear that the use of a fulcrum arm 84 and a pressure plate 32 as suggested results in a force which is applied not only by the pressure plate 32 in the region of the hinge pin 14 but also at the other end or opposing edge of the door abutting against the jamb 18. This more uniformly distributes the forces transmitted by the panel 28 to the door 12 with attendant lesser distortions and stresses being generated within the structure. Although not shown, it is clear that additional pins 50' may be provided spaced along the upper edge of the door 12 with additional slots corresponding to slot 84*c* being provided for receiving each of the additional pins. The provision of a plurality of such engaging pins even more uniformly distributes the forces to the door and minimizes deformation and the stresses generated therein.

While the use of a pressure plate 32 and a fulcrum arm 84 are particular suitable coupling means when the door and the panel are proximate to one another, the use of linkages permits the counterforce panel assembly to be placed remotely from the door. Another coupling means particularly suitable for coupling a door and a panel as above suggested when the same are remote from each other is a pulley system or arrangement 86. As with the linkage arrangements, many arrangements of links and pulley levers may be apparent to a person skilled in the art. Therefore, by way of example only, a pulley system 86 is shown in FIGS. 13 and 14 which utilizes a support extension 88 extending from the frame 22. An offset, upwardly directed pin 90 is mounted on the door and spaced from the latter. An arm or lever 92 is pivotally mounted on the support 88 and is provided with two substantially parallel angled extensions 94 and 96 which extend in opposing directions as shown in FIGS. 13 and 14. The extension 94 is positioned between the pin 90 and the frame 22, and provided with a smooth elongate surface which is engageable with the pin 90 during the initial positions of the door until the pressure seal of the latter is broken.

The pulley system 86 further includes an additional support extension 98 which extends from the frame 78 as shown and an offset upwardly directed pin 100 extends from the pressure plate 28. The upwardly directed portion of the pin 100 is spaced sufficiently from the plate 28 so as not to engage the frame 78 in all anticipated positions of the panel during movement into the associated pressure shield.

An arm or lever 102 is pivotally mounted on the support 98 and is similarly provided with two oppositely directed parallel angled extensions 104 and 106. As with the extension 94, the extension 104 is positioned between the pin 100 and the frame 78 and is provided with a smooth elongate surface and is engageable with the pin 100 when the latter moves inwardly with movements of the panel 28 into the pressure shield 36. A cable 108 is connected to the free ends of the extensions 96 and 106 and is guided along the frames 22 and 78 by means of pulleys 110, 112 and 114.

As shown schematically in FIG. 14, it will be clear that movement of the panel 28 interiorly into the pressure shield 36 causes the pin 100 to engage the extension 104 with resultant clockwise pivotal movement as viewed in FIG. 14 to a position 102' and suggested by the dashed outline. This applies a tension to the cable 108 which causes the lever or arm 92 to similarly pivot in a clockwise direction to a position 92' as suggested in dashed outline. Clockwise rotation of the arm 92 causes the extension 94 to engage the pin 90. The force acting upon the panel 24 is thereby transmitted by means of the pulley system 86 to the door 12 to urge the latter to open to a point where the pressure seal is broken and the pressures are equalized on the both sides thereof.

Referring to FIG. 13, the reference numeral 116 represents the distance or separation between the door and its frame from the panel 28 and its associated pressure shield. To provide venting of the interior of the shield to the low pressure side of the door, a duct 118 is shown which provides a low pressure path of the air within the pressure shield through the apertures 78*a*, the duct 118 and the apertures 40 within the frame 22.

What has been described above has been some examples of the presently preferred embodiments of door assist or door counterforce arrangements which facilitate the opening of a door where there is a high pressure differential on the two sides thereof. The specific manner in which the counterforce assemblies, or more specifically the counterforce panels, cooperate with the door is not of primary importance. There may be provided numerous linkage, pulley and other coupling arrangements for transmitting the forces exerted by the counterforce panel to the door to effect the minimal movement thereof required to break the seal separating the high and the low pressure zones. Accordingly, the counterforce assemblies may be disposed in a plane parallel to the door, perpendicular thereto, or in any other desired position relative to the door. As indicated, the counterforce assembly need not be immediately adjacent to the door but may be remotely spaced therefrom and coupled thereto by a suitable coupling system.

Venting of air trapped within the pressure shield is necessary to permit movement of the counterforce panel within the pressure shield without forces being exerted by otherwise trapped air which becomes compressed by the advancing panel. However, the specific manner of venting is not critical, several possible arrangements having been shown and described. In each case, it is important that the air within the pressure shield be vented to the low pressure zone so as to maintain a low pressure on the inner surface of the counterforce panel which faces interiorly of the pressure shield and a pressure differential across the panel 28 equal to that across the door. Venting to the high pressure zone would equalize the pressures on both sides of the counterforce panel and this would negate the action of this panel and the latter could not under these circumstances provide the requisite pressures or torguing action upon the door.

Numerous alterations of the structure herein disclosed will suggest themselves to those skilled in the art. However, it is to be understood that the present disclosure relates to preferred embodiments of the invention which are for purposes of illustration only and are not to be construed as a limitation of the invention.

What is claimed is:

1. A counterforce assembly for doors exposed to high pressure differentials on the two sides thereof which result in large forces acting on one side of the door tending to maintain the same closed against a door jamb, the assembly comprising a planar counterforce panel mounted for movement and exposed to substantially the same high pressure differentials to which the door is exposed to result in corresponding large forces acting on one side of said panel; coupling means connected to the door and to said panel for applying the large forces acting on said panel to the door and counteracting the large forces acting on the door so that movement of said panel when coupled to the door counteracts the large forces acting on the door and facilitates opening of the door irrespective of the magnitudes of the pressure differentials to which the door and said panel are exposed; a substantially closed pressure shield having at least one opening, said panel being mounted for substantially transverse movements within said pressure shield to define together with said pressure shield a substantially closed compartment in all positions of said panel, said one side of said panel being exposed through said at least one opening to the exterior of said compartment and to the high pressure side to which said one side of the door is exposed, the other surface of said panel facing the interior of said compartment providing a low pressure side; venting means for venting the interior of said compartment to the low pressure side to which the other side of the door is exposed so that the pressure differential is maintained the same on the door and on said panel in all positions of said panel within said pressure shield; seal means being provided between said pressure shield and said panel to prevent equalization of pressures on the two sides of said panel in the closed position of the door; said coupling means moving said panel and the door together between a first position when the door is closed and a second position when said panel is within said pressure shield and the door is opened an initial degree corresponding to the movement of said panel, said second position of the door breaking the pressure seal at the door to reduce the pressure differential across the door to a negligible quantity, said coupling means permit the door to be opened an additional degree without corresponding movement of said panel, the door being moved said additional degree without assistance of said panel.

2. A counterforce assembly as defined in claim 1, wherein the door is hingedly mounted on a hollow frame and wherein said pressure shield includes at least a hollow member exposed to the interior of said compartment, said hollow frame and hollow member being in abutment with each other, apertures being provided in said hollow member portion exposed to said compartment and in said hollow member and frame portions in abutment with each other and in said hollow frame portion exposed to the low pressure side of the door, whereby air within said compartment can be vented through said hollow member and frame when said panel moves into said pressure shield to reduce the effective volume of said compartment and forces out the air therein while maintaining the pressure differential across said panel.

3. A counterforce assembly as defined in claim 1, wherein the door is hingedly mounted on a hollow frame and wherein said pressure shield is remote from the door and includes at least a hollow member exposed to the interior of said compartment, apertures being provided in said hollow member portion exposed to said compartment and in said frame portion exposed to the low pressure side of the door; and duct means for carrying air between said hollow member and hollow frame, whereby air within said compartment can be vented through said hollow member and frame and said duct means when said panel moves into said pressure shield to reduce the effective volume of said compartment and forces out the air therein while maintaining the pressure differential across said panel.

4. A counterforce assembly as defined in claim 1, wherein said seal means includes a piano hinge which extends along one edge of said panel about which the latter is pivotally mounted.

5. A counterforce assembly as defined in claim 1, wherein said panel is mounted for pivotal movement about one edge thereof, the opposing edge of said panel defining an arc during movement of said panel, the surface of said pressure shield defining said major opening portion in abutment with said opposing edge being arcuate and corresponding to the curvature of the arc of movement of said opposing edge, whereby said pressure shield surface and opposing edge are maintained in abutting relationship to provide an air seal in all portions of said panel.

6. A counterforce assembly as defined in claim 1, wherein said panel and door are hingedly mounted on the same hinge pins, and wherein said coupling means comprises a substantially flat pressure plate connected to said panel, said pressure plate extending beyond the hinged edge of said panel to be disposed in opposition to at least a portion of the low pressure side of the door, said pressure plate abutting against the door and applying a force on the door which tends to open the door when said panel moves in response to the force acting on the same, said pressure plate moving together with said panel and the door between said first and second positions, said pressure plate being stationary with said panel when the door is moved said additional degree.

7. A counterforce assembly as defined in claim 1, wherein said panel and door include means for being mounted for pivotal movements, said coupling means including linkage means connected to said panel and door for transmitting the large forces acting on said panel to the door, an upwardly directed pin being spaced from and mounted on the door, said linkage means including a link having a hooked free end engageable with said pin in said first position of said panel and when the door is in a closed position, said pin being releasable from said hooked free end when said panel moves from its first to second positions.

8. A counterforce assembly as defined in claim 1, wherein said panel and the door are pivotally mounted on common hinges, and wherein said coupling means comprises a fulcrum arm connected to an upper edge of said panel and extending beyond the pivoted edge of said panel and at least partially exposed to an upper edge of the door, and a pin provided on the upper edge of the door engageable by said fulcrum arm during movement of said panel so that forces acting on said panel are transmitted to the door by means of said fulcrum arm and said pin to urge the opening of the door, said fulcrum arm being provided with an open ended cutout adapted to receive and release said pin with engagement between said pin and fulcrum arm terminating as said panel reaches said second position.

9. A counterforce assembly as defined in claim 7, further comprising support means connected to the frame on which the door is mounted and to said hooked free end to support the latter and prevent said linkage means from sagging under its own weight.

10. A counterforce assembly for doors exposed to high pressure differentials on the two sides thereof which result in large forces acting on the door tending to maintain the same closed against a door jamb, the assembly comprising a planar counterforce panel mounted for movement and exposed to substantially the same high pressure differentials to which the door is exposed to result in net forces acting on said panel; coupling means connected to the door and to said panel for applying the force acting on said panel to the door and counteracting the force acting on the door so that movement of said panel when coupled to the door counteracts the forces acting on the door and facilitates opening of the door irrespective of the magnitudes of the pressure differentials to which the door and said panel are exposed; said panel and door including means for being mounted for pivotal movements; said coupling means including upwardly directed pins spaced from and mounted on the door and on said panel; a lever pivotally mounted proximate each of said pins, each lever having a free end engaged with a respective pin; and a pulley arrangement connecting the other free ends of said levers, movement of said panel and pin mounted thereon causing said panel lever to move said door lever by means of said pulley arrangement, whereby said door lever applies a force to the associated pin and the door which tends to open the same in response to movement of said panel.

11. A counterforce assembly as defined in claim 10, wherein the free end of said lever mounted proximate the door pin is in the form of an elongate smooth projection disposed between the pin and the door, whereby the door pin is slidably movable with respect to said projection while in abutment against the latter.

12. A counterforce assembly as defined in claim 11, wherein said panel is movable between first and second positions, said second position of said panel being selected so that said panel and door are coupled only during initial door opening until the pressure seal at the door is broken to reduce the pressure differential across the door to a negligible quantity and the door may be opened to a desired degree without corresponding movement of said panel and without assistance of the latter, engagement between said door pin and projection terminating when said panel reaches said second position.

13. A counterforce assembly as defined in claim 10, wherein said pulley arrangement comprises a cable, and pulley wheels spaced from each other along the edges of the door and said panel, said cable being guided by said pulley wheels, whereby said pulley arrangement follows the contours of the door and said panel.

* * * * *